US005265869A

United States Patent [19]

Morita

[11] Patent Number: 5,265,869

[45] Date of Patent: Nov. 30, 1993

[54] PAPER CONVEYING APPARATUS HAVING CONVEYING ROLLERS AND INDEPENDENTLY SUPPORTED FOLLOWER ROLLERS

[75] Inventor: Takakazu Morita, Osaka, Japan

[73] Assignee: Mita Industrial Co., Ltd., Osaka, Japan

[21] Appl. No.: 983,225

[22] Filed: Nov. 30, 1992

[30] Foreign Application Priority Data

Nov. 30, 1991 [JP] Japan ..... 3-341994

[51] Int. Cl.[5] ..... B65H 5/02

[52] U.S. Cl. ..... 271/274; 271/9

[58] Field of Search ..... 271/274, 272, 273, 9

[56] References Cited

U.S. PATENT DOCUMENTS 4,431,179 2/1984 Westover et al. ..... 271/274

5,024,431 6/1991 Shimuzu et al. ..... 271/274 X

FOREIGN PATENT DOCUMENTS 139850 6/1988 Japan ..... 271/274

22750 1/1989 Japan ..... 271/274

*Primary Examiner*—Robert P. Olszewski

*Assistant Examiner*—Boris Milef

*Attorney, Agent, or Firm*—Cushman, Darby & Cushman

[57] ABSTRACT

A paper conveying apparatus having follower rollers arranged in opposition to and in contact with the rotationally driven conveying rollers and a second guide plate arranged to form a predetermined space between the second guide plate and a stationary first guide plate. The follower rollers and the second guide plate are supported on an openable/closable support plate independently of each other. The guide rollers are urged toward the conveying rollers and the second guide plate is urged toward the first guide plate independently of each other. In the above arrangement, the openable/-closable support plate can be locked and unlocked easily to facilitate closing and opening.

9 Claims, 4 Drawing Sheets

PAPER CONVEYING APPARATUS HAVING CONVEYING ROLLERS AND INDEPENDENTLY SUPPORTED FOLLOWER ROLLERS

BACKGROUND OF THE INVENTION

Field of the Invention

The present invention relates to a paper conveying apparatus of the type that can be used in copying machines, printers, paper sorters, and the like.

Description of the Related Art

A conventional paper conveying apparatus which can be used in an image forming apparatus or the like will be described with reference to FIG. 5. In the conventional paper conveying apparatus, a first guide plate 3 is mounted on a paper feeding deck body 25 so as to extend along the paper conveying direction. A second guide plate 5, which forms a paper conveying path 4 having a predetermined space t between the second guide plate 5 and the first guide plate 3, is elastically supported on an openable/closable support plate 7 and is urged toward the first guide plate 3.

The openable/closable support plate 7 has one end pivotally connected to the body 25 by a hinge 6 and the other end can be locked to the body 25 by lock mechanisms 14. Rotationally driven conveying rollers 8 and follower rollers 9 are arranged opposite to and in contact with each other. Paper sandwiched between conveying rollers 8 and follower rollers 9 is carried in the paper conveying path 4. Generally, the support plate 7 is integrated with an openable/closable door 45 provided on the side portion of the body 25 as shown in FIG. 3.

In the apparatus described above, in order for the paper to come in tight contact with the rotationally driven conveying rollers 8, the follower rollers 9 are urged towards the conveying rollers 8. To accomplish this, bearings 11 for supporting a support shaft 10 of the follower rollers 9 are elastically-supported on the second guide plate 5 by springs 12 so as to be urged toward the conveying rollers 8. Also, the second guide plate 5 is elastically supported at opposite ends by springs 13 on the support plate 7 so as to be urged toward the first guide plate 3.

Accordingly, the springs 12 for urging the follower rollers 9 and the springs 13 for urging the second guide plate 5 impose opposing urging forces on the second guide plate 5. That is, when the urging force of the springs 12 urges the follower rollers 9 against the conveying rollers 8, the second guide plate 5 is pushed against the urging force of the springs 13 and is moved to a position indicated by the dotted chain line. Thus, the predetermined space t can not be maintained between the first guide plate 3 and the second guide plate 5. Accordingly, the paper can not be carried suitably.

If the spring force of the springs 13 is increased to sufficiently maintain the space between both guide plates 3 and 5 at the predetermined value t, it is necessary to increase the hooking force of the lock mechanisms 14 provided on one end of the support plate 7. However, if the looking force of the lock mechanisms 14 is too large, it becomes much more difficult to open and close the support plate 7.

SUMMARY OF THE INVENTION

An object of the present invention is to provide a paper conveying apparatus having an openable/closable support plate that can be easily opened and closed.

To achieve this object, the present invention provides a paper conveying apparatus having a first guide plate secured in the paper conveying direction and a second guide plate proximate thereto. A paper conveying path is formed as a predetermined space between the second guide plate and the first guide plate. The second guide plate is elastically supported on an openable/closable support plate and is urged toward the first guide plate to sandwich paper between rotationally driven conveying rollers and follower rollers.

The follower rollers and conveying rollers are arranged opposite to and in contact with each other. The follower rollers are elastically supported on the openable/closable support plate and are urged toward the conveying rollers in the paper conveying path to enable the rollers to forward the paper within the paper conveying path.

The spring force for urging the follower rollers against the conveying rollers and the spring force for urging the second guide plate operate independently of each other. Therefore, the spring force being exerted on the second guide plate can be independently selected without considering the spring force on the conveying rollers. Accordingly, it is possible that the spring force being exerted on the second guide plate is relatively weaker than in the conventional apparatus thus allowing the hooking force for locking the support plate to be less than in the conventional apparatus. Hence, the support plate can be opened and closed easily.

Additional objects and advantages of the invention will be set forth in the description which follows, and in part will from the description, or may be learned by practice of the invention. The objects and advantages of the invention may be realized by means of the instrumentalities and combinations particularly pointed out in the appended claims.

DETAILED DESCRIPTION OF THE PREFERRED EMBODIMENTS

Figure 4:
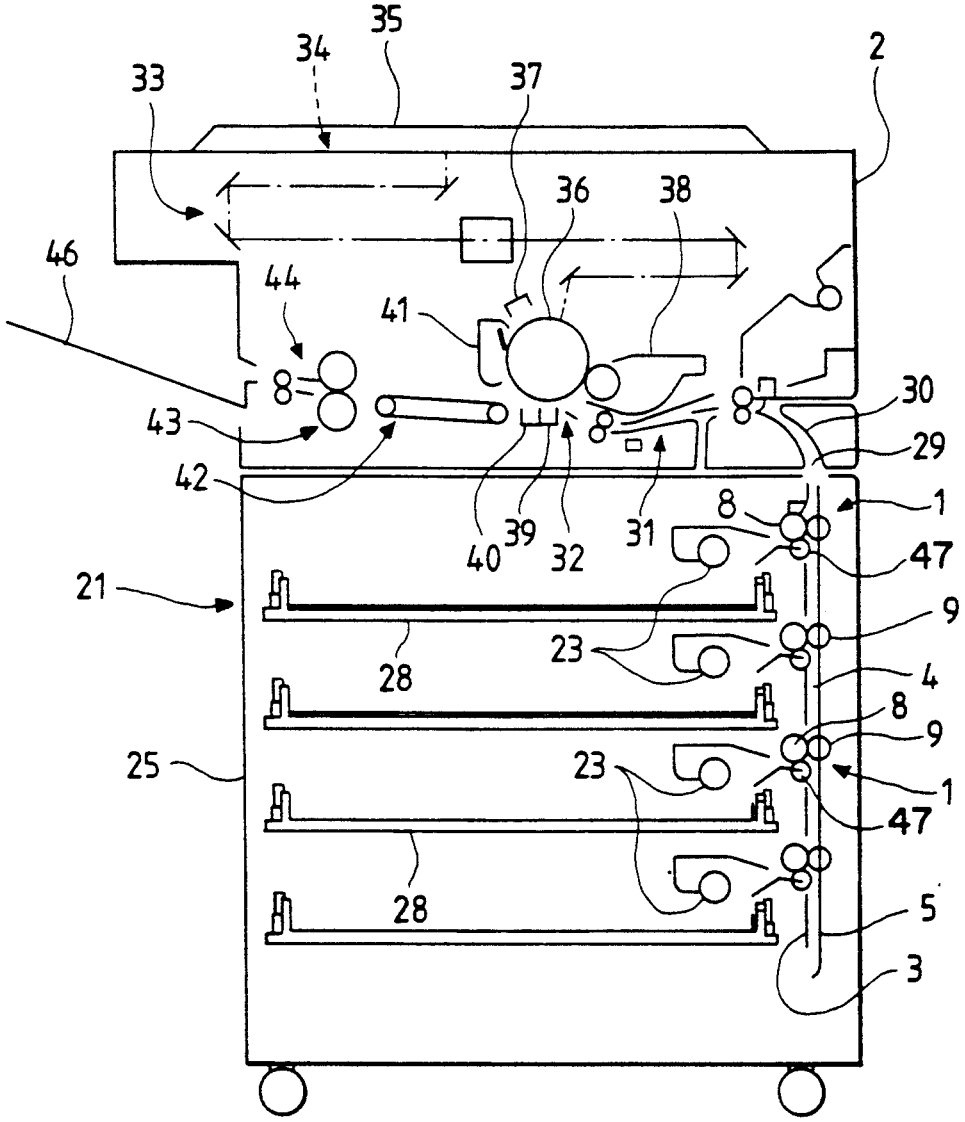
FIG. 4 is a cut away side view showing the configuration of the entire electrostatic photography copying machine.
Figure 5:
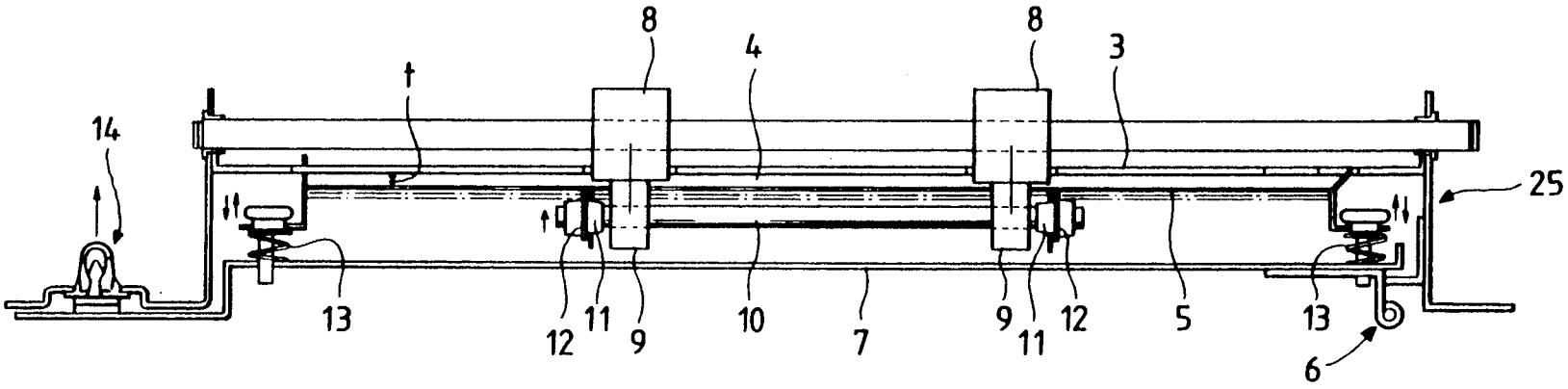
FIG. 5 (PRIOR ART)
FIG. 5 is a plan view showing a main portion of a conventional paper conveying apparatus.

FIG. 4 shows the configuration view of an electrostatic photography copying machine provided with the paper conveying apparatus 1 according to the present invention. In a deck body 25 of the paper feeding deck 21, a plurality of front loading type paper feeding cassettes 28 are horizontally mounted in stages. Paper feeding rollers 23 are provided above the front portions of the paper feeding cassettes 28, respectively. The paper conveying apparatus 1 further has a vertical paper conveying path 4 formed between opposing guide plates 3 and 5.

A paper discharge outlet 29 is provided at the top end of the paper conveying path 4 and communicates with a curved conveying path 30 in the copying machine body 2. The curved conveying path 30 further communicates with a conveying path 31 which conveys paper to the center portion of the copying machine body 2.

An image forming portion 32 for forming an image is provided at the center portion of the copying machine body 2 and an optical scanning system 33 is provided at the top portion of the copying machine body 2. A platen 34 covered with an openable/closable cover 35 is provided over the optical scanning system 33 at the upper surface of the copying machine body 2.

The image forming portion 32 comprises a photosensitive drum 36, main charger 37, a developing device 38, a transferring charger 39, a separating charger 40, and a cleaning device 41, etc., which are disposed about the circumference of the photosensitive drum 36. A conveying belt 42 is provided to convey paper from the photosensitive drum 36 to a fixing device 43. Paper discharge rollers 44 are provided proximate to the fixing device 43 to discharge paper from the fixing device 43 to a paper discharge tray 46 attached to the exterior of the copying machine body 2.

During operation of the electrostatic photography copying machine described above, an operator places an item to be copied (e.g. document) on the platen 34. The operator enters the number of copies to be made through an operation panel (e.g. ten-key panel, not shown) provided on the outside of the copying machine and activates copying start button (not shown). Then, the optical scanning system 33 detects the size of the item and the paper feeding rollers 23 feed the paper from the appropriate paper feeding cassette 28 into the paper conveying path 4.

Paper fed from any of the paper feeding cassettes 28 by its corresponding paper feeding roller 23 passes a corresponding one of the smaller-diameter rollers 42, which contacts its corresponding one of the conveying rollers 8, and enters the paper conveying path 4. The paper entering the paper conveying path 4 abuts against the second guide plate 5, bends upward and is conveyed through the paper conveying path 4 by the conveying rollers 8 and the follower rollers 9 toward the paper discharge outlet 29. The paper passes through the paper discharge outlet 29 and enters the curved conveying path 30 in the copying machine body 2.

In the copying machine body 2, the paper is fed from the curved conveying path 30, which communicates with the paper discharge outlet 29, to the conveying path 31. The paper is then conveyed through the conveying path 31 to the image forming portion 32 at the center portion of the copying machine body 2. The optical scanning system 33 exposes the item on the platen 34 to form an image on the photo-sensitive drum 36 and the image is transferred on the paper. Then, the paper is separated from the drum and conveyed by the conveying belt 42 to the fixing device 43. The fixing device 43 grabs the paper and the paper discharge rollers 44 discharge the paper onto the paper discharge tray 46.

Figure 3:
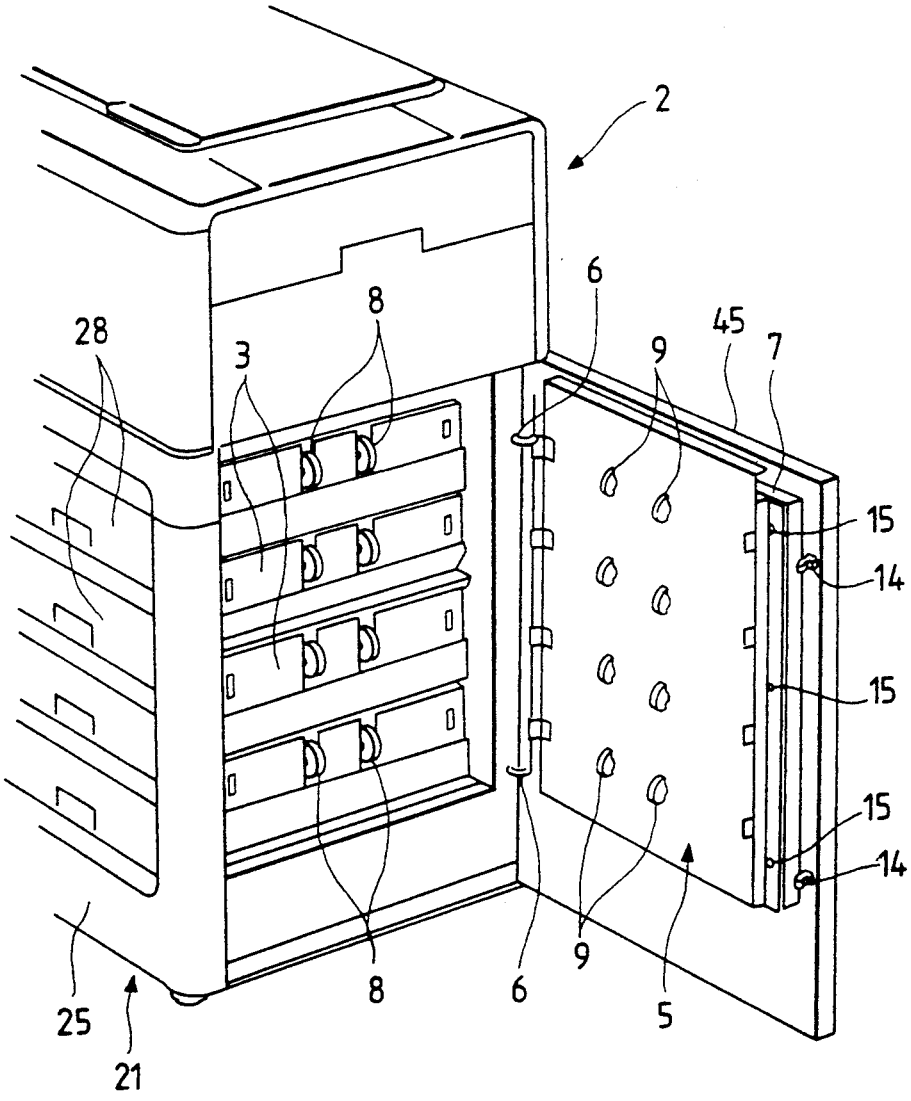
FIG. 3 is a perspective view showing a support plate of the paper conveying apparatus cooperating with an electrostatic photography copying machine.

As shown in FIG. 3, first guide plates 3 are fixedly supported in the deck body 25 and are mounted in the vertical direction corresponding to the conveying direction of the paper. A second guide plate 5 is elastically supported on a support plate 7 which can be connected to the inner surface of a door 45 or integral with the door 45. The door 45 is openably/closably supported by the deck body 25 by hinges 6 and is locked in a closed position by lock mechanisms 14.

Figure 1:
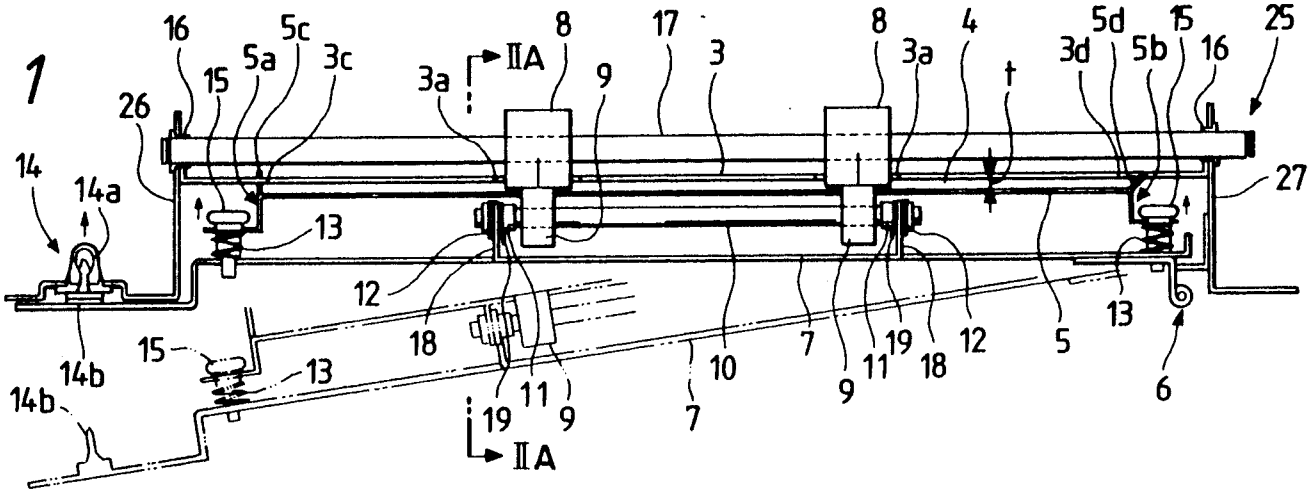
FIG. 1 is a plan view showing a main portion of an embodiment of the paper conveying apparatus according to the present invention.

As shown in FIG. 1, in the closed position of the door 45, the paper conveying path 4 having a predetermined space t is formed between each of the first guide plates 3 and the second guide plate 5 which is elastically supported on the support plate 7. One end of the support plate 7 is pivotally coupled to the side plate 27 of the deck body 25 by hinges 6, while the other end of the support plate 7 is lock-hooked by the lock mechanisms 14 to the side plate 26 of the deck body 25.

Reception portions **14*a* of the lock mechanisms 14 are attached to the side plate 26, and insertion portions 14*b* extending from the support plate 7 insert into the reception portions 14*a* to lock the support plate 7 and the door 45 (see FIG. 3) in the closed position. When a handle (not shown) of the door 45 is pulled, the support plate 7 can be opened together with the door 45** as shown by a dotted chain line.

The first guide plate 3 is secured at its opposite ends to side plates 26 and 27 of the deck body 25. In the position corresponding to each of the paper feeding cassettes 28, a pair of openings **3*a* are formed in the corresponding first guide plate 3, and the corresponding conveying rollers 8 are secured to driving shaft 17 so that the conveying rollers 8 partially project outwardly from the openings 3*a* into the paper conveying path 4. The driving shaft 17 is supported by a pair of bearings 16 secured to the side plates 26 and 27**, respectively, and is rotated by a driving source (not shown).

The second guide plate 5 has flange portions **5*a* and 5*b* bent outward at its opposite ends. Guide holes are formed in the flange portions 5*a* and 5*b*. Bolts 15 are implanted on the support plate 7 and project inward toward guide plates 3. The guide holes formed in the flange portions 5*a* and 5*b* of the second guide plate 5 each have a diameter slightly larger than that of the bolts 15. Thus, bolts 15 pass through guide holes 5*a* and 5*b***, respectively.

Springs 13 interposed between the flange portions **5*a* and 5*b* and the support plate 7 urge the second guide plate 5 away from the support plate 7 so that the flange portions 5*a* and 5*b* abut against head portions of the bolts 15. Thus, the paper conveying path 4 having the predetermined space t is formed between the first and second guide plates 3 and 5 when the support plate 7** is in the closed position.

Guide pieces **5*c* and 5*d* project from the flange portions 5*a* and 5*b* and are guided in the guide holes 3*c* and 3*d* formed in the first guide plates 3. Therefore, if the support plate 7 and/or door 45 slants relative to the deck body 25, the guide pieces 5*c* and 5*d* of the second guide plate 5 always correctly align the second guide plate 5 relative to the first guide plates 3**. Accordingly, slant feeding of the paper can effectively be prevented.

In the paper conveying path 4, the small-diameter follower rollers 9 are elastically supported on the support plate 7 by springs 12 and oppose the large-diameter rotationally driven conveying rollers 8 when the support plate 7 is in the closed position. The springs 12 urge the follower rollers 9 toward the conveying rollers to contact the conveying rollers 8. The conveying rollers 8 are driven to rotate at fixed positions in the paper conveying paths 4.

Figure 2A:
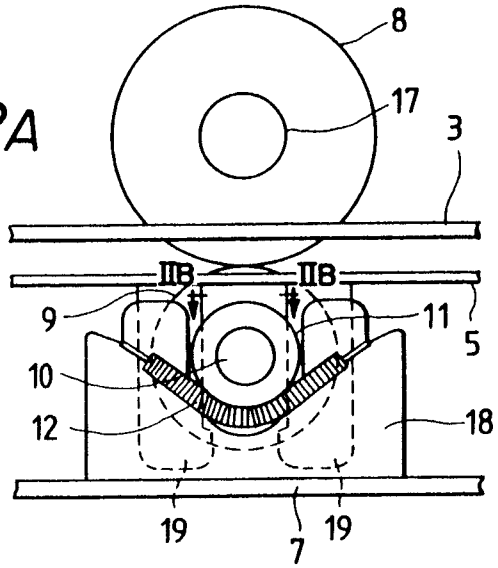
FIG. 2A is a side view taken along the direction of arrows IIA—IIA in FIG. 1.
Figure 2B:
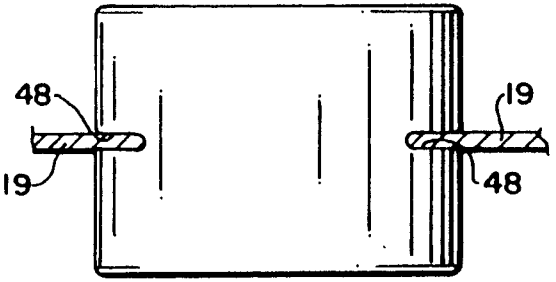
FIG. 2B is a top view taken along the direction of arrows IIB—IIB in FIG. 2A.

As shown in FIG. 2A, a pair of support brackets 18 are formed on the support plate 7 at its inner side and project inward toward the guide plates 3 when the support plate 7 is in the closed position. Bearings 11 for supporting the support shaft 10 of the follower rollers 9 are held by the springs 12 suspended between the opposite shoulder portions of the brackets 18. Guide brackets 19 for guiding the bearings 11 respectively are formed on the second guide plate 5 and project outward. Vertical grooves 48, as shown in FIG. 2B, in which inside edges of the guide brackets 19 are loosely inserted are formed in the bearings 11 at their front and rear sides, respectively.

Because of this configuration, the springs 12 urge follower rollers 9 toward the conveying rollers 8 without being influenced by the forces exerted on the second guide plate 5 by springs 13. That is, the springs 12 for urging the follower rollers and the springs 13 for urging the second guide plate 5 do not interfere with each other. Thus, the respective spring forces of the springs 12 and 13 can be selected to have suitable values independently of each other. Accordingly, the spring force of the springs 13 for urging the second guide plate 5 can be selected to be a value relatively weaker than that in the conventional apparatus, and the hooking force of the lock mechanism 14 can be small thus allowing the door 45 to be locked and unlocked easily to facilitate opening and closing.

Although the preferred embodiment of this invention has been described, it will be obvious to those skilled in the art that various changes and modifications may be made therein without departing from the invention. Therefore, the claims are intended to include all such changes and modifications that fall within the true spirit and scope of the invention.

What is claimed is:

1. A paper conveying apparatus comprising:

first and second guide plates having first and second openings therein, respectively;

a support plate, movable between a first and second position, for positioning said second guide plate at said first position where said second guide plate is substantially parallel to said first guide plate and said second position different from said first position, said first and second guide plates forming a paper conveying path when said second plate is at said first position;

at least one conveying roller projecting into said paper conveying path through said first opening in said first guide plate;

at least one follower roller projecting into said paper conveying path through said second opening in said second guide plate;

first means for urging said second guide plate away from said support plate, said first urging means positioning said second guide plate at a predetermined distance away from said first guide plate when said support plate is at said first position; and second means for urging, independently of said first means, said at least one follower roller toward said at least one conveying roller.

2. A paper conveying apparatus as claimed in claim 1, wherein said second urging means further comprises:

at least one first projection extending from said support plate and at least one second projection extending from said second guide plate; and elastic means, coupled to said at least one first projection, for supporting said follower roller;

said first and second projections and said elastic means cooperating to project said follower roller through said second opening.

3. A paper conveying apparatus as claimed in claim 2, further comprising:

a bearing; and a first shaft coupled to said follower roller and said bearing and projecting in a rotational axial direction therefrom;

said first and second projections, said elastic means and said bearing cooperating to project said follower roller through said second opening.

4. A paper conveying apparatus as claimed in claim 1, further comprising first and second bolts secured to said support plate, said first and second bolts each having an extended portion and a flange at one end thereof; and wherein:

said second guide plate has first and second holes therein, said extended portion of said first and second bolts passing through said first and second holes, respectively; and said first urging means comprises elastic means, said elastic means urging said second guide plate to abut against said flanges of said first and second bolts to position said second guide plate at said predetermined distance away from said first guide plate.

5. A paper conveying apparatus as claimed in claim 1, further comprising:

first and second side plates, said first guide plate being secured to said first and second side plates and said support plate being pivotally secured to said first side plate; and means for removably locking said support plate to said second side plate when said support plate is at said first position.

6. A paper conveying apparatus as claimed in claim 3, wherein said bearing has at least one groove therein and a portion of said at least one second projection nests with said at least one groove.

7. A paper conveying apparatus as claimed in claim 1, wherein:

said first guide plate has first guide holes therein; and said second guide plate has first guide projections extending therefrom;

said first guide projections cooperating with said first guide holes to align said first and second guide plates.

8. A paper conveying apparatus as claimed in claim 5, wherein said locking means further comprises:

a locking projection extending from said support plate; and a locking opening in said second side plate, said locking projection cooperating with said locking opening to removably lock said support plate to said second side plate.

9. A paper conveying apparatus as claimed in claim 1, further comprising a plurality of said follower rollers and a plurality of said conveying rollers.

* * * * *